US005595032A

United States Patent [19]

Richards et al.

[11] Patent Number: 5,595,032

[45] Date of Patent: Jan. 21, 1997

[54] BUILDING BLOCKS

[75] Inventors: Jeffrey Richards, West Molesey; Martin C. Harvey, Camberley, both of Great Britain

[73] Assignee: Dow Corning Hansil Limited, Byfleet, United Kingdom

[21] Appl. No.: 386,994

[22] Filed: Jan. 19, 1995

[30] Foreign Application Priority Data

Jan. 28, 1994 [GB] United Kingdom ..... 9401687

[51] Int. Cl.[6] ..... E04C 1/42

[52] U.S. Cl. ..... 52/306; 52/307; 52/171.3

[58] Field of Search ..... 52/306, 307, 308, 52/172, 171.3, 786.11, 786.13; 428/344, 345, 426, 428, 429; 156/107, 109

[56] References Cited

U.S. PATENT DOCUMENTS

| | | | |
|---|---|---|---|
| 2,224,488 | 12/1940 | Rendall | 52/306 |
| 4,053,210 | 10/1977 | Michoelin | 52/306 X |
| 4,887,404 | 12/1989 | Saji et al. | 52/306 |
| 4,986,048 | 1/1991 | McMarlin | 52/306 |
| 5,009,048 | 4/1991 | Paul | 52/306 X |

OTHER PUBLICATIONS

Howley's Condensed Chemical Dictionary, 11th Edition, p. 1039–1040.

*Primary Examiner*—Carl D. Friedman
*Assistant Examiner*—W. Glenn Edwards
*Attorney, Agent, or Firm*—Roger H. Borrousch

[57] ABSTRACT

A hollow, glass, building block contains elastomeric or gel-like cured polydiorganosiloxane composition product being optically at least translucent and present in an amount sufficient to fill completely the available interior volume of the building block providing a space adjacent to the cured product to permit expansion of the cured product relative to the block during changes in temperature. This glass building block has improved fire resistance.

4 Claims, 1 Drawing Sheet

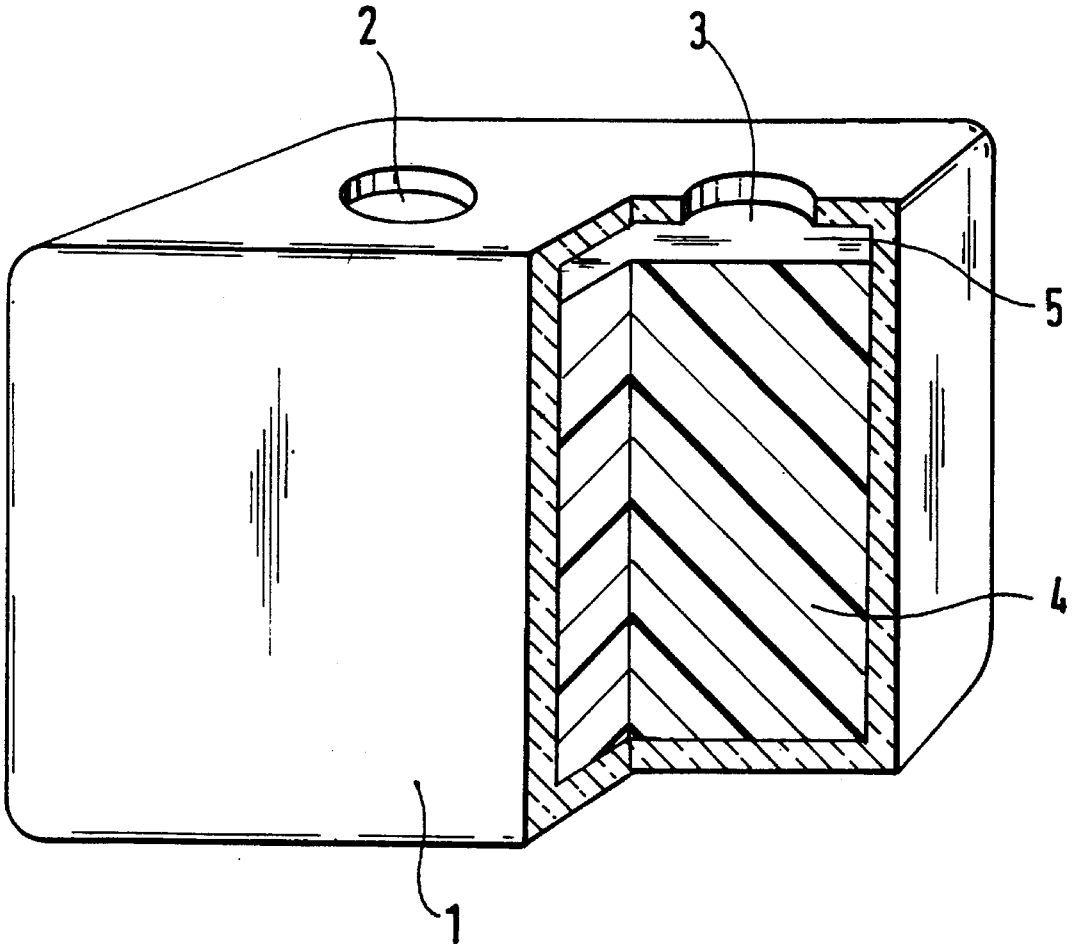
2
3
5
4
1

BUILDING BLOCKS

BACKGROUND

This invention relates to improved building blocks. More particularly it relates to glass building blocks having improved aesthetic and fire resistant properties.

The use of glass blocks in building construction is well-known. They are employed in place of masonry bricks in walls, for example where it is desired to permit viewing through an exterior wall. They are also employed to form internal walls or parts thereof to permit the passage of light and/or for aesthetic reasons.

In GB 1 294 308 there is described a building block comprising a hollow transparent body partially filled with a liquid (e.g. water) and having one oblique wall such that light can be reflected, refracted and filtered by the body of the blocks and by the contained liquid.

In GB 1 495 951 there is described a wall structure comprising a plurality of superposed hollow blocks of material transparent to visible light such as glass. The blocks are partially filled with a transparent liquid (e.g. water) and also contain a prismatic body such that light can be reflected, refracted and filtered. Such a building block is capable of transmitting light through the wall.

It is also known from U.S. Pat. No. 2,724,260 that certain faces of glass blocks may be coated with a thin film of organopolysiloxane to prevent the adhesion of mortar thereto.

Glass building blocks are normally hollow and while, to some extent, they perform a practical and aesthetic function it would be advantageous if either or both of these functions could be enhanced.

We have now found that such an advantage may be realised if there is introduced into a hollow glass block an organosiloxane composition which is thereafter cured to an elastomeric or gel-like state.

SUMMARY OF THE INVENTION

Accordingly this invention provides a hollow, glass, building block which contains the elastomeric or gel-like product of curing a polydiorganosiloxane composition, said cured product being optically at least translucent and present in an amount insufficient to fill completely the available interior volume of the bulding block whereby there is provided a space adjacent to the cured product which permits expansion of the cured product relative to the block during changes in temperature thereof.

BRIEF DESCRIPTION OF THE DRAWINGS

The figure is a perspective view of a glass block of the invention with a part cut out in section.

Polydiorganosiloxane compositions suitable for use according to the invention are those which are curable to an elastomeric or gel-like state, preferably at normal ambient (22° C.) or moderately elevated temperatures, for example up to about 100° C. Such curable compositions comprise a polydiorganosiloxane having silicon-bonded reactive groups, preferably hydroxyl groups or alkenyl groups, and one or more substances for effecting cross-linking of the polydiorganosiloxane via the reactive groups. The composition may or may not contain a catalyst for initiating or expediting the crosslinking reaction. The preferred curable compositions are those comprising two or more components. In compositions of this type the relevant reactive components are separately packaged, the contents of the packages being mixed when formation of the cured (crosslinked) product is to occur. Curable compositions of the two-component type include those comprising mixtures of a polydiorganosiloxane having terminal, silicon-bonded hydroxyl groups and silanes having alkoxy groups and/or partial hydrolysates of such silanes, for example n-propyl silicate and ethyl polysilicate. Cure of the compositions is normally catalysed by incorporation of a metal organic compound in particular a metal carboxylate such as stannous octoate, dibutyltin diacetate or dibutyltin dilaurate. Compositions of this type are well known in the silicone art and are described in, for example, GB Patents 841 825, 1 295 194 and 1 304 362.

Most preferred for use according to the present invention are organosiloxane compositions comprising (A) a polydiorganosiloxane having at least two silicon-bonded ethylenically-unsaturated groups, (B) at least one organo-hydrogen siloxane having at least two silicon-bonded hydrogen atoms per molecule and (C) a catalyst for promoting the addition of SiH groups to the said unsatu-rated groups. Elastomer- and/or gel-forming compositions comprising (A), (B) and (C) are well-known and have been described in British Patents 849 885, 945 580, 1 189 270, 1 581 762 and 1 281 343 and U.S. Pat. No. 3,020,260. Compositions comprising (A), (B) and (C) cure by a reaction which does not produce flammable by-products. They are therefore particularly preferred for applications where fire resistance is a desired property.

Preferably at least 70 percent of the total silicon-bonded substituents in the polydiorganosiloxane are methyl groups, any remaining substituents being selected from the required reactive groups, alkenyl groups, phenyl groups, alkyl groups having from 2 to 8 carbon atoms and fluorinated alkyl groups having from 3 to 8 carbon atoms. The reactive groups in polydiorganosiloxane (A) are silicon-bonded ethylenically unsaturated groups, preferably those having from 2 to 8 carbon atoms, for example vinyl, allyl or hexenyl groups. The proportion of such groups required in the polydiorganosiloxane to realise the desired elastomeric or gel-like product will be known to, or readily ascertainable by, those skilled in the art of silicone chemistry. Generally the proportion of alkenyl groups does not exceed about 2 or 3 percent of the total number of silicon-bonded substituents in the molecule. The alkenyl groups may be present attached to terminal silicon atoms or to non-terminal silicon atoms or to both.

Examples of the preferred polydiorganosiloxanes (A) include copolymers of dimethylsiloxane, methylvinylsiloxane and trimethylsiloxane units, copolymers of dimethylsiloxane, phenylmethylsiloxane and dimethylvinylsiloxane units, copolymers of dimethylsiloxane, methylhexenylsiloxane and dimethylhexenylsiloxane units, copolymers of dimethylsiloxane, methylvinylsiloxane and phenyldimethylsiloxane units and mixtures of two or more such polydiorganosiloxanes.

Crosslinker (B) is well-known in the art of organosiloxane elastomers and gels. Organohydrogensiloxanes (B) have on average at least 2 silicon-bonded hydrogen atoms per molecule. The remaining valencies of the silicon atoms are satisfied with organic groups selected from alkyl groups having from 1 to 6 carbon atoms e.g. methyl, ethyl and hexyl and phenyl groups. Preferred from cost and availability considerations are organohydrogensiloxanes in which at least 80% and more preferably substantially 100% of the total organic substituents are methyl. The organohydrogensiloxanes (B) may be homo-polymers or copolymers, for example they may be polymethyl-hydrogen-siloxanes, trimethylsiloxy-terminated polymethyl-hydrogen-siloxanes, copolymers of dimethylsiloxane, methyl-hydrogen-siloxane and trimethylsiloxane units and copolymers of dimethylsiloxane, methylhydrogensiloxane and dimethylhydrogensiloxane units. Crosslinker (B) may comprise a single organohydrogen-siloxane or two or more different organohydrogen-siloxanes having for example different chain lengths and/or different contents of silicon-bonded hydrogen atoms. The proportion of (B) employed should be at least sufficient to provide the desired degree of crosslinking during cure. Depending on the type and structure of the organohydrogensiloxanes the proportion required may vary widely. Generally, however, the proportion of (B) will fall within the range from about 5 to about 40 parts by weight per 100 parts by weight of (A).

Platinum catalyst (C) can be any of the known forms effective in promoting the reaction of SiH groups with silicon-bonded alkenyl groups. Known and suitable forms of platinum are well documented in the literature and include chloroplatinic acid, platinum compounds and complexes of platinum compounds with unsaturated organic compounds or with siloxanes having silicon-bonded groups containing olefinic unsaturation. Examples of platinum catalysts (C) are complexes of platinous halides and olefines such as ethylene, propylene, cylcohexene and styrene, complexes of platinum halides or chloroplatinic acid with divinyltetramethyl disiloxane (see U.S. Pat. No. 3,419,593) and complexes formed by the reaction of chloroplatinic acid, divinyltetramethyldisiloxane and tetramethyl-disiloxane. An amount of the platinum catalyst should be present which is effective in promoting the desired reaction. In general an effective amount is that which provides from 5 to 200 parts by weight of Pt per million parts of the combined weights of (A) and (B).

Fillers and other additives may be incorporated into the curable polydiorganosiloxane provided that they do not impair the desired degree of transparency or translucency in the cured composition. Suitable fillers include certain types of silicone elastomers in finely divided powder form, certain types of silica and benzene-soluble resinous copolymers of $R_3SiO_{0.5}$ units and $SiO_2$ units wherein the R groups are preferably methyl but preferably also include a minor proportion, generally up to 20 percent of the total R groups, of alkenyl, e.g. vinyl, groups. Resinous copolymers of this type are well-known in the silicone art and can be prepared by the method described in, for example, U.S. Pat. No. 2,676,182. The ratio of $R_3SiO_{0.5}$ units to $SiO_2$ units may vary from about 0.5:1 to about 1:1, preferably from 0.6:1 to 0.8:1.

Other additives which may advantageously be present in the curable compositions include substances for improving the adhesion of the cured composition to the glass block and substances which confer flame retardant properties, for example compounds of transition metals such as titanium butoxide and zirconium octoate. It has been found that the incorporation of low molecular weight polydimethylsiloxane having terminal triorganosiloxy groups, wherein the organo groups are alkyl or aryl, can improve the adhesion of the cured gel to the interior of the glass block. Such polydiorganosiloxanes can also be added to lower the modulus of the cured product where this is desirable in order to reduce stresses caused by differential expansion and contraction during changes in the ambient temperature.

Glass blocks according to the invention have an aesthetic appeal and also demonstrate good fire resistance, which renders them more suitable for use in providing fire resistant walls.

A glass block according to the invention is illustrated by way of example in the accompanying drawing which represents a perspective view with a part cut away in section. In the drawing a glass block (1) has fill holes (2) and (3) in its upper space. Contained within the block is a cured gel or elastomer (4). An air space or vacuum (5) is present above the surface of the gel or elastomer to accommodate any expansion thereof during changes in the ambient temperature. The fill holes (2) and (3) should be large enough to permit the introduction of the curable composition but should not be so large as to reduce significantly the surface area required for adhesion of the blocks to each other during construction. If desired the two fill holes (2) and (3) may be replaced by a single fill hole.

The curable composition is introduced into the block via the fill hole whilst still in a liquid or flowable condition. It is then allowed to cure to the gel-like or elastomeric state. Preferably the composition is selected and formulated so that cure will take place at normal ambient temperatures. However, if desired cure may be accelerated by exposure to higher temperatures, for example 40° C. to 70° C.

One suitable curable composition was formed by mixing two component parts (Parts A and B).

Part A was prepared by mixing 86.4 parts of a dimethylvinylsiloxy-end stopped polydimethylsiloxane ($4.5\times10^{-4}m^2/s$), 2 parts of a trimethylsiloxy-end stopped polymethylhydrogen siloxane ($3\times10^{-5}$ $m^2/s$) 18 parts of a copolymer of dimethylsiloxane and methylhydrogen siloxane ($5\times10^{-6}$ $m^2/s$), 0.6 part methylvinylcyclote-trasiloxane and 10.7 parts of a polydimethyl-siloxane having terminal triorganosilsoxy groups and of viscosity 20 cSt.

Part B was prepared by mixing 99.9 parts of a dimethylvinylsiloxy-end stopped polydimethylsiloxane ($2\times10^{-3}$ $m^2/s$) and 0.2 part of a complex of chloroplatinic acid and divinyltetramethyldisiloxane.

Parts A and B were mixed in a weight ratio of approximately 7.5:92.5 to provide a curable composition in which the ratio of reactive vinyl groups to reactive silicon-bonded hydrogen atoms is approximately 1 or slightly less than 1.

That which is claimed is:

1. A hollow, glass, building block which contains the elastomeric or gel-like product of curing a polydiorganosiloxane composition, said cured product being optically at least translucent and present in an amount insufficient to fill completely the available interior volume of the bulding block whereby there is provided a space adjacent to the cured product which permits expansion of the cured product relative to the block during changes in temperature thereof.

2. A building block as claimed in claim 1 wherein the polydiorganosiloxane composition comprises (A) a polydiorganosiloxane having at least two silicon-bonded ethylenically-unsaturated groups, (B) at least one organohydrogen siloxane having at least two silicon-bonded hydrogen atoms per molecule and (C) a catalyst for promoting the addition of the SiH groups in (B) to the ethylenically-unsaturated groups in (A).

3. A building block as claimed in claim 1 wherein the polydiorganosiloxane composition contains a polydimethylsiloxane having terminal triorganosiloxy groups wherein the organic groups are alkyl or aryl.

4. A building block as claimed in claim 1 wherein the polydiorganosiloxane composition comprises a silicone elastomer in powder form.

* * * * *